US007380665B2

(12) United States Patent
Ohms

(10) Patent No.: US 7,380,665 B2
(45) Date of Patent: Jun. 3, 2008

(54) ORGANIZER

(76) Inventor: Justin William Ohms, 420 Ames Pl., Ferguson, MO (US) 63135

( * ) Notice: Subject to any disclaimer, the term of this patent is extended or adjusted under 35 U.S.C. 154(b) by 798 days.

(21) Appl. No.: 10/955,992

(22) Filed: Sep. 30, 2004

(65) Prior Publication Data

US 2006/0065661 A1 Mar. 30, 2006

(51) Int. Cl.
*B65D 21/02* (2006.01)
*B65D 85/62* (2006.01)

(52) U.S. Cl. ..... 206/509; 206/373; 220/23.83

(58) Field of Classification Search ..... 206/373, 206/499, 509, 519; 220/23.83, 23.88; 221/4, 221/5, 86, 91; 211/69.8, 70, 70.6, 78
See application file for complete search history.

(56) References Cited

U.S. PATENT DOCUMENTS 4,911,295 A * 3/1990 Venegoni ..... 206/372
5,154,303 A * 10/1992 Jordan ..... 220/23.86
5,379,885 A * 1/1995 Chen ..... 206/216
5,386,922 A * 2/1995 Jordan ..... 220/23.83
5,547,098 A 8/1996 Jordan ..... 220/23.86
5,669,498 A * 9/1997 Fierek et al. ..... 206/373
5,890,614 A * 4/1999 Dancyger ..... 220/23.6
5,936,446 A * 8/1999 Lee ..... 327/172
6,059,109 A 5/2000 Stein ..... 206/373
6,296,118 B1 * 10/2001 Speck ..... 206/408

* cited by examiner

*Primary Examiner*—Anthony Stashick
*Assistant Examiner*—Harry A Grosso
(74) *Attorney, Agent, or Firm*—Richard D. Fuerle

(57) ABSTRACT

An organizer has a circular wheel having sides that slope inward towards the bottom of the wheel. The said sides are joined to a central cylinder by at least two double-sided partitions joined at the top and open at the bottom, thereby forming at least two compartments within said circular wheel between the partitions, the sides, and the central cylinder. Each double-sided partition forms a channel under it that is open on the bottom and joins the center of the central cylinder to the outside of the wheel. The organizer also has a hub that formed of a band joined to a circular disc by a support that extends less than half way around the circumference of the disc. The band can be removably attached to the central cylinder.

22 Claims, 7 Drawing Sheets

ORGANIZER

BACKGROUND OF THE INVENTION

This invention relates to an organizer that can be used with a bucket. In particular, it relates to a nestable organizer having a wheel that is connected to a central hub, where the wheel has at least two compartments separated by double-sided partitions and the hub has an indentation into which a 2×4 can be inserted.

An organizer is a container for holding various objects, such as tools, parts, and materials. An organizer will typically have compartments or dividers to separate various items. Some can be easily carried and can be attached to ladders, furniture, etc. for easy access. For example, U.S. Pat. No. 5,547,098 discloses a "Container with Stackable Trays and Adjustable Partitions" which converts a bucket into "an organized receptacle for storing and dispensing small parts or objects." U.S. Pat. No. 6,059,109 discloses a stackable "Article Storage Tray" that is insertable within the upper portion of an empty container such as a five gallon bucket; it can also be placed over the upper rim of the container. Also see U.S. Pat. No. 5,669,498, which discloses an organizer that has multiple stacking heights and can be used inside a bucket.

SUMMARY OF THE INVENTION

The organizer of this invention is much more versatile and useful than previous organizers. It can be easily attached to a 2×4 or to the side of a bucket. The hub of the organizer can be removed and attached to the side of the wheel of the organizer. The organizer has at least two compartments, each of which can be divided into smaller compartments. The hub of an organizer can be inverted and attached to another organizer. The organizer can also be nested in three different modes, a very compact mode and two modes where the organizers are separated so that items can be placed in them.

DESCRIPTION OF THE PREFERRED EMBODIMENTS

Figure 1:
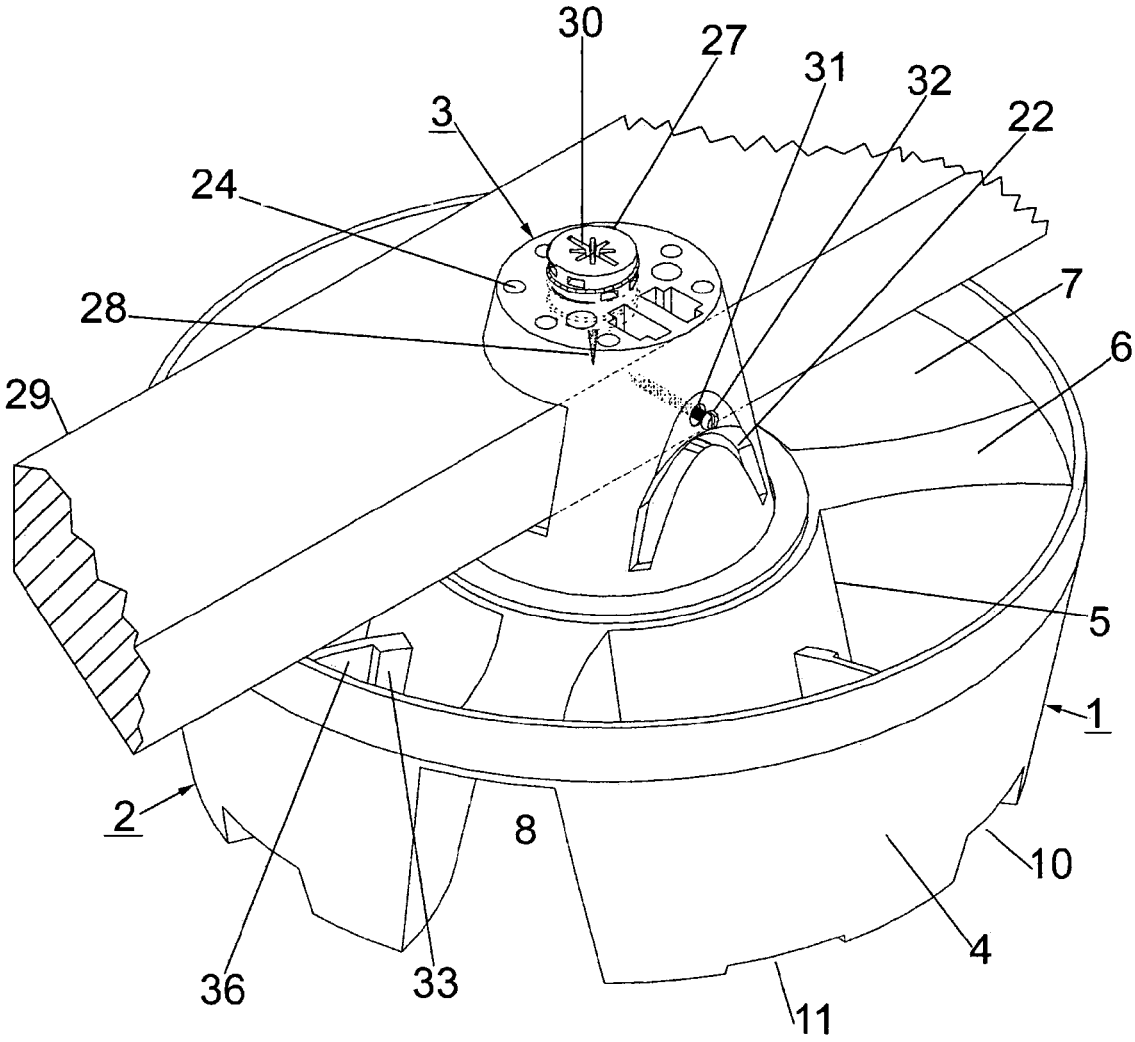
FIG. 1 is an isometric view of a certain presently preferred embodiment of an organizer according to this invention attached to a 2×4.

In FIGS. 1 to 6, organizer 1 has wheel 2 removably attached to hub 3. While the organizers may be made of any size, they are preferably of a size suitable for use with buckets, such as a five gallon bucket, which may have a diameter at the top of about 11¼ inches and may be about 14 inches deep, a 4½ gallon bucket, which may have a diameter at the top of about 11½ inches and may be about 13 inches deep, or an extra high 5 gallon bucket, which may have a diameter at the top of about 11¼ inches and may be about 16 inches deep. If the outside diameter of the organizer is slightly less than the inside diameter of the bucket, 3 or more organizers can be nested and carried inside a bucket. Wheel 2 preferably has a diameter of about 9½ to about 11¼ inches with sides preferably about 3 to about 4 inches high so that one or more organizers will fit into a 5 gallon bucket. Wheel 2 is circular and has sides 4 that are sloped in towards the base of wheel 2. Sides 4 should be sloped sufficiently, preferably at an angle from the vertical of about 8 to about 12 degrees, so that the organizers can be nested.

Figure 5:
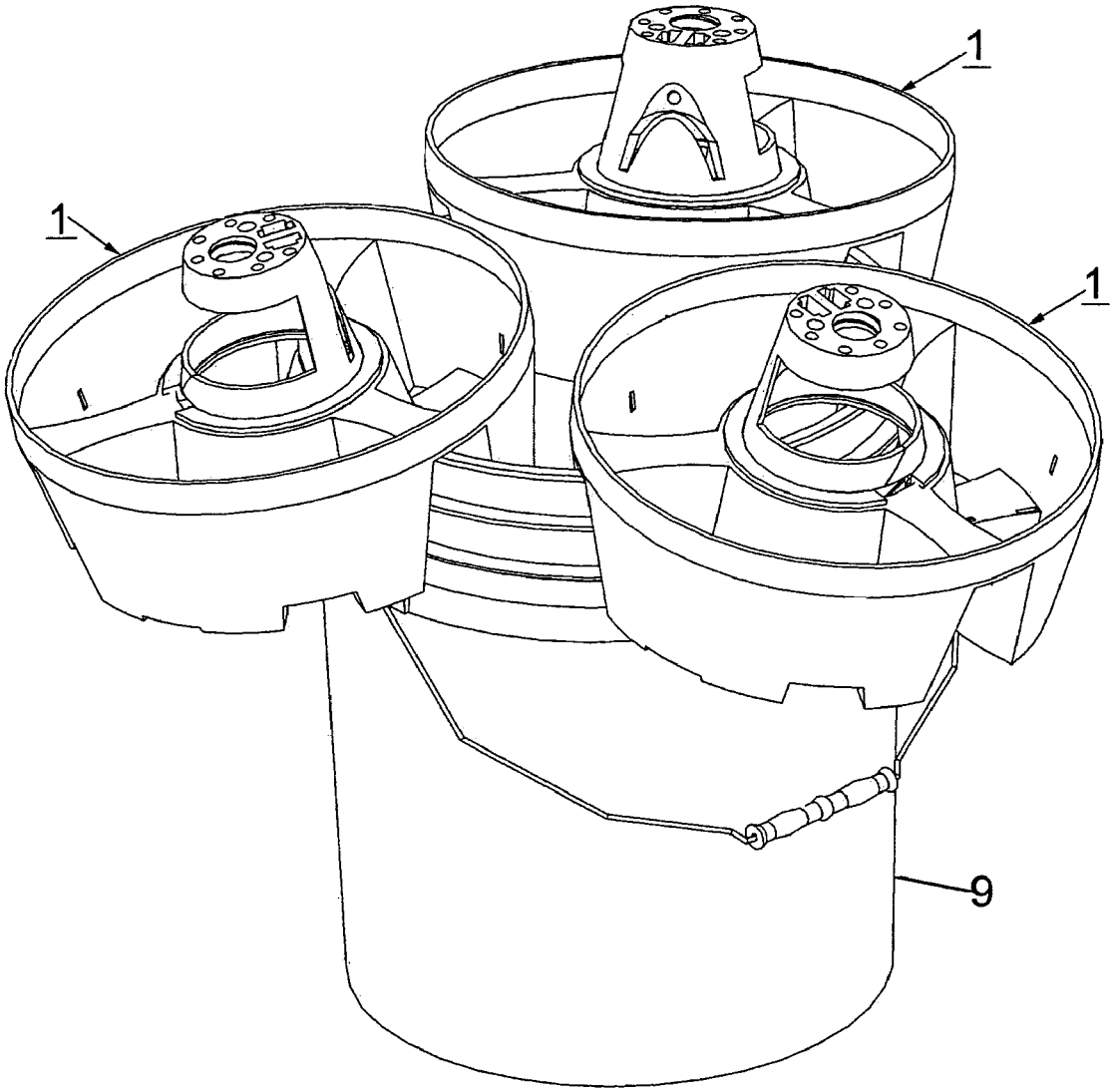
FIG. 5 is an isometric view of three of the organizers of FIG. 1 attached to the side of a bucket.

Wheel 2 has a central cylinder 5 that is open at both ends. Cylinder 5 is preferably sloped at an angle from the vertical of about 8 to about 12 degrees so that the organizers can be nested. Hub 3 is preferably sloped at the same angle as cylinder 5 so that it fits into the inside of cylinder 5. Cylinder 5 is joined to sides 4 by three equally spaced apart partitions 6. Each partition 6 has two sides that are joined at the top. Partitions 6 thereby create three compartments 7 between sides 4 and cylinder 5 and also create three channels 8. Channels 8 are open to the outside of wheel 2, are open to the inside of cylinder 5, and are open at the bottom (see FIG. 3). Channels 8 enable organizer 1 to be mounted on the side of bucket 9, as shown in FIG. 5. In order for wheel 2 to be capable of being mounted on the side of a bucket, two of the channels 8 should be about 110 to about 130 degrees apart. While wheel 2 may have only two channels 8 (and therefore only 2 compartments 7 and only two partitions 6), it preferably has three, spaced 120 degrees apart, so that any two of the channels 8 will fit over the edge of a bucket. Channels 8 are preferably about 2½ inches to about 3½ deep and about 1 to about 2 inches wide.

Figures 6A, 6B, 6C:
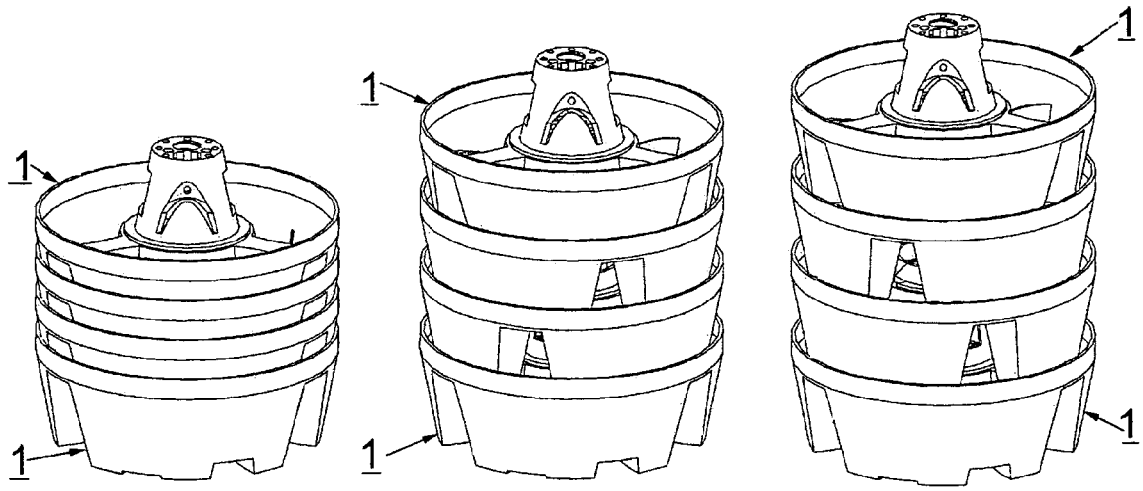
FIGS. 6*a*, 6*b*, and 6*c* are isometric views showing three modes in which the organizer of FIG. 1 can be nested.

Crossing the outside of the base of each compartment 7 are two grooves 10 and 11. Groove 10 may be about ½ to about 1 inch deep and groove 11 may be about ⅛ to about ½ inches deep. Grooves 10 and 11 are slightly wider than the width of the top of partitions 6, and are similarly shaped, so that 2 or more organizers can be nested in different modes. Referring to FIG. 6*a*, four organizers 1 are nested in the most compact mode by inserting the partitions of lower organizers into the channels of higher organizers. This high-compaction mode may be used to save storage space for shipment or while on retailer shelves. In FIG. 6*b*, four organizers 1 are nested in a less compact mode, where groves 10 of higher organizers rest on the top of partitions 6 of lower organizers. When stacked four deep, this medium compaction mode allows the rim of wheel 2 of the top most organizer to rest below the rim of a 4.5 gallon bucket. When stacked five deep, this medium compaction mode also allows the rim of wheel 2 of the top most organizer to rest below the rim of an extra deep 5 gallon bucket. In FIG. 6*c*, four organizers 1 are nested in the least compact mode, where grooves 11 of higher organizers rest on partitions 6 of lower organizers. This low compaction mode provides increased usable storage volume over the medium compaction mode and, when stacked four deep, allows the rim of wheel 2 of the top most organizer 1 to rest below the rim of a standard 5 gallon bucket. The relative height of the stack of organizers is important. If the rim of the top most wheel 2 extends above the rim of the bucket, the wheel 2 will have decreased contact with the inside wall of the bucket and may become unstable during transport. If the organizer extends too far above the rim of the bucket, the wheel 2 or the hub 3 may interfere with the operation of the bucket handle. Furthermore, if the rim of the top most wheel 2 is below the rim of the bucket, then the center hubs 3 may be removed or inverted and a lid may then be placed on the bucket for extended storage. Shorter or taller buckets are also envisioned with the height of the bucket being irrelevant to this invention.

Figure 2:
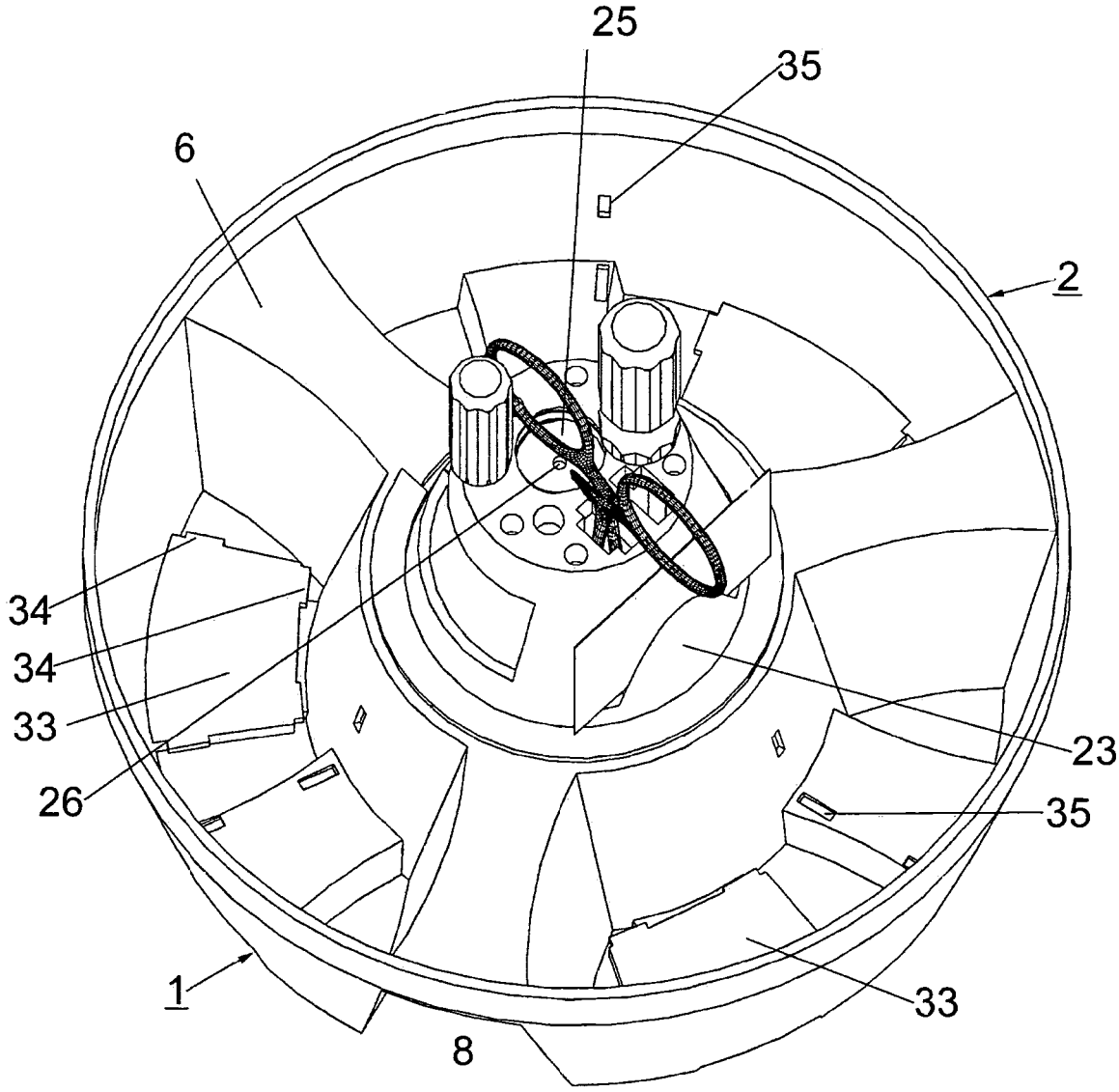
FIG. 2 is an isometric view of the top of the organizer of FIG. 1, showing the inside of the compartments.
Figure 3:
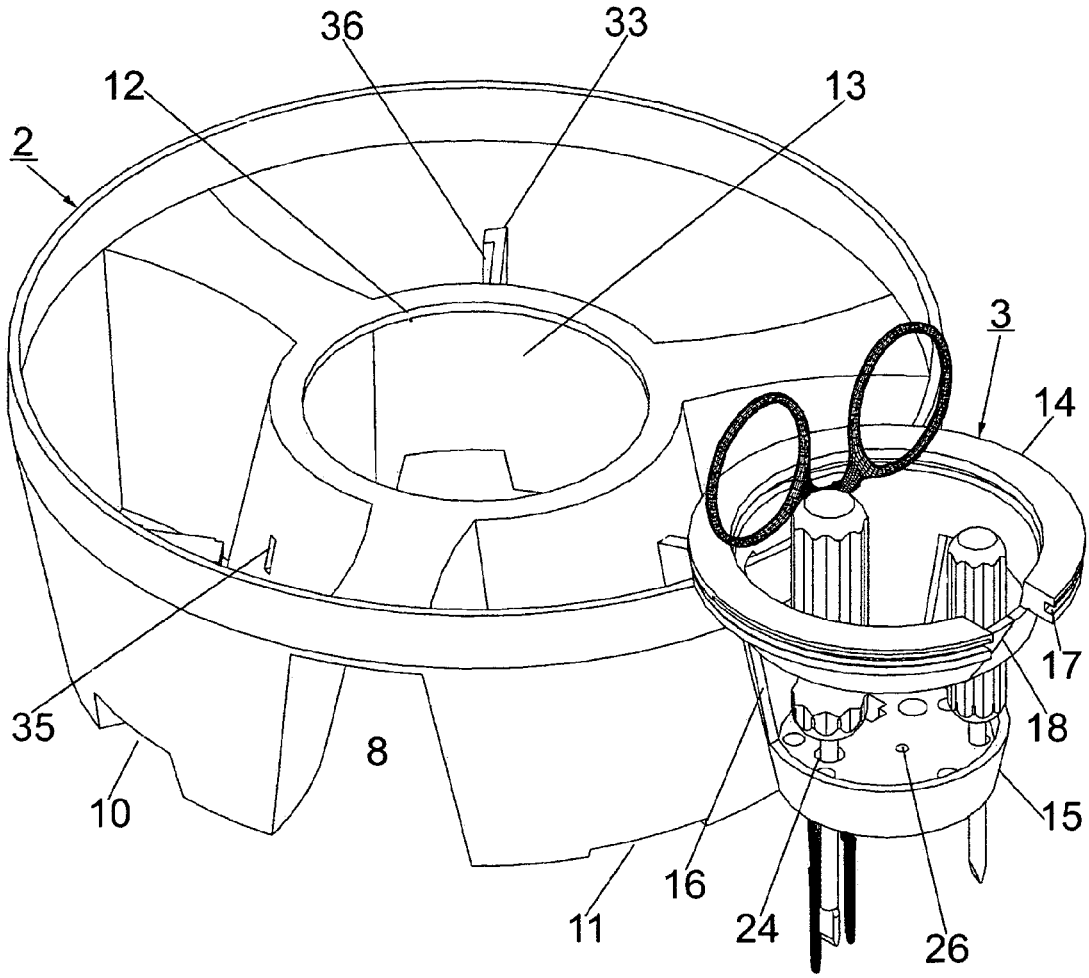
FIG. 3 is an isometric view of the top of the organizer of FIG. 1, with the hub attached to the side of the wheel.

Referring to FIG. 3, cylinder 5 has inwardly-extending rim 12, leaving a central aperture 13 that may have a diameter of about 3½ to about 4½ inches. Hub 3 has a circular band 14 that is joined to a disc 15 by support 16. Band 14 is provided with circumferential indentation 17 and has a sloped slit 18 therethrough, opposite support 16. The inside diameter of circumferential indentation 17 is about the same as the diameter of rim 12. To attach hub 3 to wheel 2, band 14 is squeezed inwardly so that band 14 slides apart at slit 18, thereby reducing the diameter of band 14 until it can be inserted into aperture 13 so that rim 12 fits inside circumferential indentation 17; when band 14 is no longer squeezed, it resumes its original shape, thereby holding hub 3 to wheel 2. To remove hub 3 from wheel 2, band 14 is squeezed and hub 3 is pulled out though aperture 13. Hub 3 may be attached to wheel 2 in an upright position, as shown in FIGS. 1, 2, 4, and 6, or in an inverted position, as shown in the upper organizer in FIG. 4.

Figure 7A:
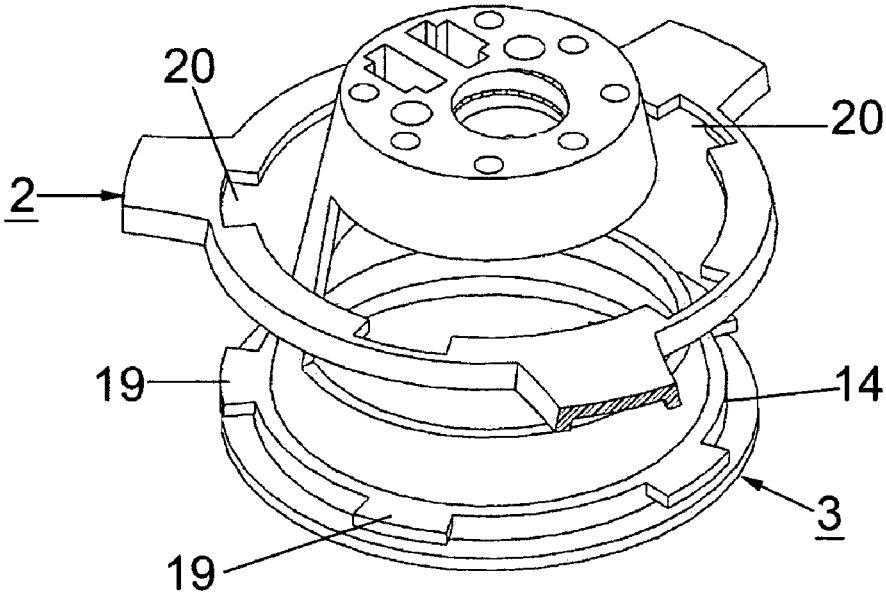
FIGS. 7*a* and 7*b* are isometric partially cut-away views showing two alternative means for attaching the hub to the wheel.
Figure 7B:
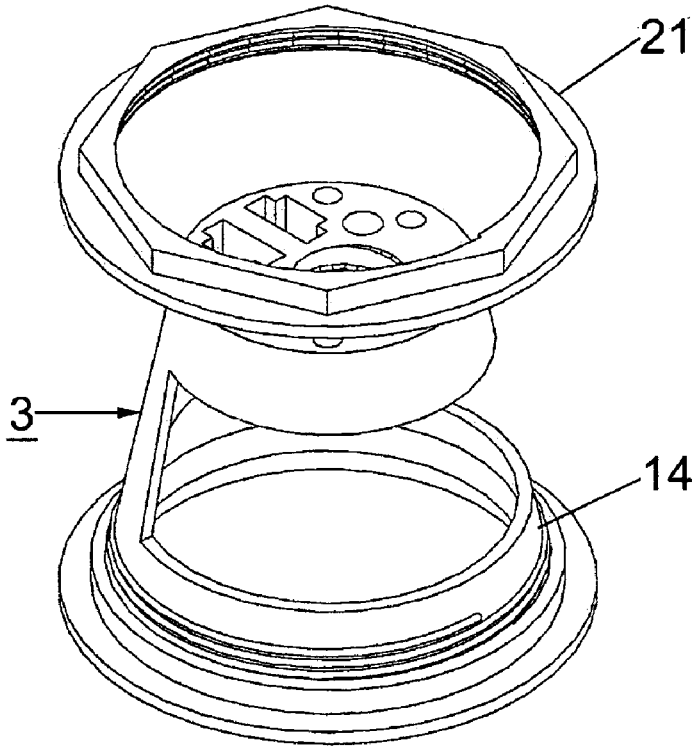

FIGS. 7*a* and 7*b* show alternative means for attaching hub 3 to wheel 2. In FIG. 7*a*, band 14 is unslotted, but has outwardly-extending tabs 19 that fit though slots 20 in rim 12 of wheel 2 (only a portion of which is shown), so that hub 3 may be inserted through aperture 13 from beneath wheel 2, then rotated slightly to secure it to wheel 2. In FIG. 7*b*, band 14 is unslotted, but male-threaded, and a correspondingly female-threaded nut 21 is also provided. Hub 3 may be inserted through aperture 13 from beneath wheel 2 and nut 21 may be screwed onto band 14 to secure hub 3 to wheel 2. As still another alternative, the inside of rim 13 may be female threaded so that band 14 screws directly into rim 13.

Support 16 extends less than half way around hub 3 in order to provide a slot in which a 2×4 may be inserted, as shown in FIG. 1. Support 16 is provided with a card slot 22 which forms a clip 23, so that cards and other thin materials may be held. Also, when hub 3 is inverted, hub 3 may be attached over the edge of wheel 2, as shown in FIG. 3, by inserting the edge into card slot 19.

Disc 15 may have a number of apertures 24 therethrough for holding screwdrivers, scissors, or other tools, as shown in FIG. 3. Disc 15 also has an female threaded inversion screw hole 25 that extends most, but not all, of the way through disc 15, and a smaller central hole 26 that extends the remaining distance through disc 15. Inversion screw 27 has male threads that engage the threads of screw hole 25. Screw 27 is provided with a central spike 28 at one end that can pass through central hole 26 in disc 15. Organizer 1 may be attached to 2×4 29 (see FIG. 1) by screwing inversion screw 27 into screw hole 25 using dual slotted screwdriver and Phillips screwdriver hole 30 until spike 28 engages 2×4 29. Organizer 1 may also be attached to 2×4 29 by means of screw 31, which is inserted through aperture 32 in support 16.

Figure 4:
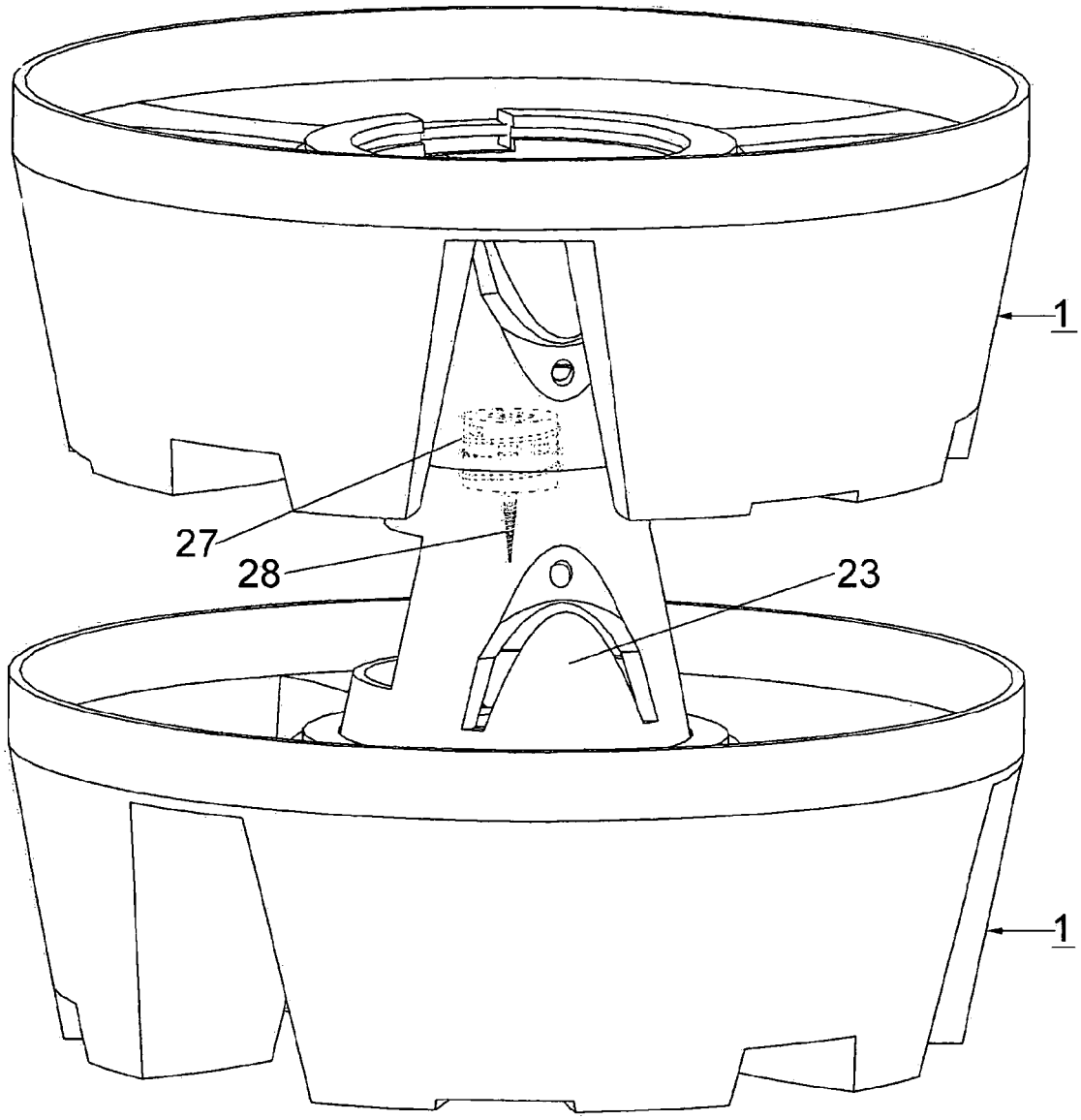
FIG. 4 is an isometric view of the side of two of the organizers of FIG. 1, with the hub of one organizer inverted and attached to a second organizer.

Screw hole 25 is preferably about ¼ to about ¾ inches off-center in disc 15 to help alleviate torque transferred by twisting apart organizers that were joined together, as shown in FIG. 4, thereby reducing the stress on support 16. The threads on screw hole 25 and screw 27 may be designed so that when two organizers are joined together, as shown in FIG. 4, the tops of their hubs will make contact when the hubs are aligned.

As shown in FIGS. 1 and 2, organizer 1 may be provided with three dividers 33 to divide compartments 7 into smaller compartments. Each divider 33 is provided with notches 34, which may be inserted into slots 35 in the sides and the base of compartments 7. Each divider 33 also has a channel 36 across it into which the raised portion of the base over groove 10 fits, so that the divider may be stored at the bottom of wheel 2 when not in use, as shown in FIG. 2.

The organizer is preferably made of plastic, such as polycarbonate, polyethylene, polypropylene, or polyvinyl chloride, but it may also be made of other materials, such as steel or aluminum.

The organizer may be used to hold screws, nails, and tools for those working up on a ladder or on framing. The organizers may be transported to the work site inside a bucket and then mounted on the ladder, on an open framing member, or on the side of the bucket. The organizers may be more permanent installed over a workbench or in a craft area. Several rows of horizontal 2×4s may be installed with several organizers mounted on each 2×. In the embodiment shown in FIG. 4, the organizer could be used to organize crafts or sewing supplies on a table or on a sewing machine. The organizers could be used in any configuration in an office environment or a school to organize office or school supplies, pens, pencils, rubber bands,

What is claimed is:

1. An organizer comprising (A) a circular wheel having sides that slope inward towards the bottom of said wheel, where said sides are joined to a central cylinder by at least two double-sided partitions joined at the top and open at the bottom, thereby forming at least two compartments within said circular wheel between said partitions, said sides, and said cylinder, where each double-sided partitions forms a channel thereunder that is open on the bottom and joins the center of said central cylinder to the outside of said wheel;

(B) a hub that comprises a band joined to a circular disc by a support that extends less than half way around the circumference of said disc; and (C) means for removably attaching said band to said central cylinder.

2. An organizer according to claim 1 including means for removably attaching the top of the hub of a first organizer to the top of the hub of a second organizer.

3. An organizer according to claim 1 wherein said disc has a female-threaded aperture and said organizer includes a male-threaded screw that engages said threaded aperture, whereby the hub of a first organizer is removably attachable to the inverted hub of a second organizer.

4. An organizer according to claim 3 where said female-threaded aperture extends only part of the distance through said disc and a smaller central aperture extends the remaining distance, and said male-threaded screw has a central spike at one end that passes through said smaller central aperture.

5. An organizer according to claim 3 wherein said female-threaded aperture is not concentric with said disc.

6. An organizer according to claim 1 wherein said hub is attachable to the top or the bottom of said central cylinder.

7. An organizer according to claim 1 wherein said organizer has three compartments separated by equally spaced apart partitions.

8. An organizer according to claim 7 wherein the partitions of a first organizer fit into the channels of a second organizer, whereby a multiplicity of said organizers can be nested.

9. An organizer according to claim 7 wherein two grooves extend across the outside of the base of each of said compartments, whereby a first organizer can be nested on top of a second organizer with the top of the partitions of said first organizer fitting into the grooves in said second organizer.

10. An organizer according to claim 9 wherein said two grooves extend across the outside of the base of each of said compartments, one groove being deeper than the other, whereby a first organizer can be nested on top of a second organizer with the top of said partitions of said first organizer fitting into either of said two grooves in said second organizer.

11. An organizer according to claim 1 wherein said support is slotted to form a card slot, whereby thin materials can be into said slot.

12. An organizer according to claim 1 wherein said disc has at least one aperture therethrough for holding tools.

13. An organizer according to claim 1, including at least one divider for dividing a compartment into two smaller compartments.

14. An organizer according to claim 1 wherein said central cylinder has an inwardly-extending rim and said band has a circumferential indentation that is cut though at an angle at a location opposite said support, whereby said band can be squeezed and said inwardly-extending rim can be inserted into said circumferential indentation to attach said hub to said wheel.

15. An organizer according to claim 1 wherein said central cylinder has an inwardly-extending slotted rim and said band has outwardly-extending tabs that can pass through said slots, whereby said hub can be attached to said wheel by inserting said hub into said central cylinder and turning it.

16. An organizer according to claim 1, including a female-threaded nut, wherein said central cylinder has an inwardly-extending rim and said band is male threaded to engage-said female-threaded nut, whereby said hub can be attached to said wheel by inserting said hub into said central cylinder and securing said nut to said band.

17. An organizer according to claim 1 wherein the outside diameter of said hub is less than the inside diameter of said central cylinder, whereby the hub of a first organizer fits into the central cylinder of a second organizer.

18. An organizer according to claim 1 wherein said central cylinder is sloped outward at the bottom and said hub is sloped at the same angle.

19. At least two organizers according to claim 1 nested with the partitions of lower organizers fitting into the channels of higher organizers.

20. Two organizers according to claim 1, a first organizer having its hub attached to extend above said wheel and a second organizer having its hub attached to extend below said wheel, and means for removably attaching said hubs together.

21. An organizer comprising (A) a circular wheel having sides that slope inward towards the bottom of the wheel, where said sides are joined to a central cylinder by three double-sided partitions joined at the top and open at the bottom, thereby forming three compartments within said circular wheel between said partitions, said sides, and said central cylinder, where each double-sided partitions forms a channel thereunder that is open on the bottom and joins the center of said cylinder to the outside of said wheel, whereby the side of a bucket can be inserted into any two of said channels to hold said organizer onto said bucket;

(B) a hub that comprises a band that is joined to a circular disc by a support that extends less than half way around the circumference of said disc, where said disc has a female-threaded aperture and is attachable to said central cylinder; and (C) a male-threaded screw that engages said female-threaded aperture, whereby the hub of a first organizer can be joined to the inverted hub of a second organizer by means of said male-threaded screw.

22. An organizer comprising (A) a circular wheel that comprises (1) sides the slope inward towards the base of said wheel;

(2) a central cylinder open at the top and bottom; and (3) three equally spaced apart double-sided partitions that extend between said sides and said central cylinder, where the sides of each partition are joined at the top and open at the bottom and both ends, thereby forming three equal compartments within said circular wheel and three channels that extend from the outside of said wheel to the center of said central cylinder;

(B) a hub that comprises (1) a band attachable to said central cylinder;

(2) a circular disc; and (3) a support that extends from said band to said circular disc and extends less than half way around the circumference of said disc, thereby forming a slot into which a 2×4 can be inserted, said disc having a female-threaded aperture;

(C) a male-threaded screw that engages said female-threaded aperture, whereby the hub of a first organizer can be joined to the inverted hub of a second organizer; and (D) three dividers removably attachable within said compartments for dividing said compartments into smaller compartments.

* * * * *